US011493188B2

(12) United States Patent
Jiang

(10) Patent No.: US 11,493,188 B2
(45) Date of Patent: Nov. 8, 2022

(54) LIGHTING EFFECT ADJUSTMENT SYSTEM WITH SLIDING EFFECT MODULE

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 17/490,050

(22) Filed: Sep. 30, 2021

(65) Prior Publication Data

US 2022/0065427 A1 Mar. 3, 2022

Related U.S. Application Data

(63) Continuation of application No. PCT/CN2021/074043, filed on Jan. 28, 2021.

(30) Foreign Application Priority Data

Aug. 31, 2020 (CN) ..... 202021865952.7

(51) Int. Cl.
*F21V 17/00* (2006.01)
*F21V 5/04* (2006.01)
(Continued)

(52) U.S. Cl.
CPC ..... *F21V 17/002* (2013.01); *F21V 5/007* (2013.01); *F21V 5/04* (2013.01); *F21V 14/00* (2013.01);
(Continued)

(58) Field of Classification Search
CPC . F21V 5/04; F21V 5/007; F21V 17/06; F21V 17/002; F21V 14/00; F21W 2131/406
See application file for complete search history.

(56) References Cited

U.S. PATENT DOCUMENTS

2005/0052872 A1* 3/2005 de Peralta ..... F21V 11/02 362/321
2008/0247025 A1* 10/2008 Jurik ..... F21V 11/18 359/234
(Continued)

FOREIGN PATENT DOCUMENTS

CN 206593014 U 10/2017
CN 208312079 U 1/2019
(Continued)

OTHER PUBLICATIONS

Yuan et al., Stage Lamp, 2019, CN209325524U, Espacenet English Translation https://worldwide.espacenet.com/patent/search/family/067727253/publication/CN209325524U?q=pn%3DCN209325524U (Year: 2019).*
(Continued)

*Primary Examiner* — Rajarshi Chakraborty
*Assistant Examiner* — Michael Chiang
(74) *Attorney, Agent, or Firm* — Lerner, David, Littenberg, Krumholz & Mentlik, LLP

(57) ABSTRACT

A lighting effect adjustment system includes a light source module, and a focusing module, a magnification module and a light output lens that are arranged in sequence along a beam projection direction of the light source module. The focusing module, the magnification module and the light output lens are mounted on a stage light holder, The focusing module and the magnification module are independently slidable in a light path direction. An effect module is further slidably arranged between the focusing module and the light output lens. The effect module includes one or more effect sheets configured to be switched into and out from a light path, and motions of the effect module and the magnification module are independent without interference with each other.

10 Claims, 8 Drawing Sheets

(51) Int. Cl.

| | |
|---|---|
| ***F21V 5/00*** | (2018.01) |
| ***F21V 17/06*** | (2006.01) |
| ***F21V 14/00*** | (2018.01) |
| *F21W 131/406* | (2006.01) |

(52) U.S. Cl.
CPC ..... *F21V 17/06* (2013.01); *F21W 2131/406* (2013.01)

(56) References Cited

U.S. PATENT DOCUMENTS

2009/0231854 A1* 9/2009 Jurik ..... F21S 10/02 362/293
2009/0303723 A1* 12/2009 Cavenati ..... F21V 5/048 362/268
2010/0061100 A1* 3/2010 Quadri ..... F21S 10/007 362/293
2011/0103074 A1* 5/2011 Jurik ..... F21V 11/18 362/355
2013/0058094 A1* 3/2013 Jurik ..... F21V 11/14 362/277
2014/0233244 A1* 8/2014 Jurik ..... F21V 14/06 362/319
2016/0238217 A1* 8/2016 Latteo ..... F21V 5/048
2019/0390840 A1* 12/2019 Kopeckova ..... F21V 14/06
2020/0191362 A1 6/2020 Kopeckova et al.

FOREIGN PATENT DOCUMENTS

CN 209116261 U 7/2019
CN 209325524 U * 8/2019
CN 209325524 U 8/2019
CN 210771979 U 6/2020

OTHER PUBLICATIONS

International Search Report for Application No. PCT/CN2021/074043, dated Jun. 2, 2021, 5 pages.

* cited by examiner

LIGHTING EFFECT ADJUSTMENT SYSTEM WITH SLIDING EFFECT MODULE

CROSS REFERENCE TO RELATED APPLICATIONS

The present application is a continuation of International Application No. PCT/CN2021/074043, filed on Jan. 28, 2021, which claims priorities from Chinese Patent Application No. 202021865952.7 filed on Aug. 31, 2020, all of which are hereby incorporated herein by reference.

TECHNICAL FIELD

The present invention relates to the technical field of stage lights and, more particularly, to a lighting effect adjustment system with sliding effect module.

BACKGROUND

Stage lights are stage arrangement instruments for rendering show scenes, showing environments by light colors and changes thereof, rendering atmospheres, highlighting main characters, and creating senses of space and time for a stage, thereby clarifying stage scenes, improving performance effects, making backgrounds natural, lining up scenarios, providing cues and guidance for viewers, and adjusting the atmospheres of stage.

In the existing technology, a stage lighting effect adjustment system includes a light source module, a focusing module, a magnification module, and a light output module that are arranged in sequence. The focusing module can be slid back and forth along a light path so as to adjust sharpness of a light spot. The magnification module is moved between the focusing module and the light output module so as to achieve angular adjustment of stage lights. An effect module provided with an effect sheet, such as a prism sheet or a frosting sheet, is usually incorporated into the lighting effect adjustment system in order to provide richer stage lighting effects. In conventional design, the effect module is fixed on the focusing module (as shown in FIG. 1) such that the effect module is slid back and forth in a light path direction following the focusing module. Then the effect sheet is switched in directly above a focusing lens of the focusing module to add a beam effect. The effect sheet occupies a motion space of the magnification module in the light path direction and shortens a range where the magnification module can adjust an angle of a stage light. Meanwhile, when the magnification module is close to the focusing module, especially when a gap in the light path direction between the magnification module and the focusing module is smaller than a space required for the effect sheet to switch into the light path, the effect sheet will be blocked by the magnification module. As a result, the effect sheet cannot switch into the light path, so that the stage light cannot exhibit effects such as prism or frosting at certain angles, thus the stage light cannot switch in stage effects such as prism or frosting at all angles.

SUMMARY

The present invention thus provides a lighting effect adjustment system with sliding effect module which is capable of preventing switch-in of stage effects from being affected by angles of a stage light.

According to the present invention, the lighting effect adjustment system with sliding effect module includes a light source module, a focusing module, a magnification module and a light output lens that are arranged in sequence along a beam projection direction of the light source module. The focusing module, the magnification module and the light output lens being mounted on a stage light holder. The focusing module and the magnification module are independently slidable in a light path direction. An effect module is further slidably arranged between the focusing module and the light output lens. The effect module includes one or more effect sheets configured to be switched into and out from a light path, and motions of the effect module and the magnification module are independent without affecting each other The effect module is configured to slide independently according to the present invention, and the motions of the effect module and the magnification module do not interfere with each other. Such arrangement of the system makes the effect module free from interference of the magnification module, the effect sheet thus can be switched into the light path at any position between the focusing module and the light output lens. Therefore, the effect module can flexibly switch the effect sheet into the light path, thereby eliminating limitation caused by the magnification module on switch-in of the effect sheet and constraints on light angle adjustment caused by the switch-in of the effect sheet, and thus enabling a stage light to switch in the effect sheet, such as prism or mirror frosting, at all angles, and allowing the stage light to exhibit richer stage effects.

In addition, due to the independent slidable arrangement of the effect module, the effect sheet may be switched into the light path close to the magnification module, such that a light beam exiting the effect sheet can be projected onto the magnification module as fully as possible, or such that a light beam exiting the magnification module can be projected onto the magnifying effect sheet as fully as possible, which can reduce light leakage.

The effect module has a first position located on one side adjacent to the focusing module of the magnification module, and a second position located on one side away from the focusing module of the magnification module. When a gap in the light path direction between the focusing module and the magnification module is larger than or equal to a gap required for the effect sheet to be switched in, the effect module is slid to the first position to switch the effect sheet into the light path. When the gap in the light path direction between the focusing module and the magnification module is less than the gap required for the effect sheet to be switched in, the effect module is slid to the second position to switch the effect sheet into the light path.

The stage light holder may include a first side plate and a second side plate that are arranged to face each other. The effect module and the magnification module are slidable between the focusing module and the light output lens by a first lifting component arranged on the first side plate and a second lifting component arranged on the second side plate, respectively. The effect module and the magnification module are arranged on the first side plate and the second side plate, respectively, and are controlled independently by the first lifting component and the second lifting component, so that sliding or holding of the magnification module and the effect module will not influence each other. The sliding of the effect module and the magnification module do not interfere with each other, so that the effect module can be selectively moved to the first position or the second position to switch the effect sheet into the light path according to the gap in the light path direction between the magnification module and the focusing module.

The first lifting component includes a first slide rail arranged on the first side plate and parallel to the light path direction. The effect module includes, on one end adjacent to the first side plate, a first sliding member that is slidable on the first slide rail. The second lifting component includes a second slide rail arranged on the second side plate and parallel to the light path direction. The magnification module includes, on one end adjacent to the second side plate, a second sliding member that is slidable on the second slide rail. The effect module is slid by sliding the first sliding member on the first slide rail, and the magnification module is slid by sliding the second sliding member on the second slide rail. Such design is simple and easy to operate.

One end adjacent to the first side plate and one end adjacent to the second side plate of the focusing module are slidably arranged on the first side plate and the second side plate, respectively. The one end adjacent to the first side plate and the one end adjacent to the second side plate of the focusing module are both slidable between the first side plate and the second side plate, which can smoothen sliding movement of the focusing module.

The effect module further includes a clamping bracket and a first driving mechanism. The clamping bracket includes a swing arm and a support plate. One end of the swing arm holds the effect sheet while the other end thereof is movably arranged on the support plate. The first driving mechanism is arranged on the support plate and drives the swing arm to switch into and out from the light path. The support plate is defined as a base plate. The swing arm and the first driving mechanism can be sequentially mounted on the support plate according to design, thereby facilitating removal and mounting. Meanwhile, the clamping bracket can also be mounted with a plurality of the effect sheets, so that superposition of a plurality of types of effect sheets can be achieved in a convenient manner, and richer light colors can thus be provided.

The first driving mechanism includes a motor, a synchronous belt, a drive wheel, and a driven wheel. The drive wheel is fixed to an output shaft of the motor. The driven wheel is fixed to one end away from the effect sheet of the swing arm. The drive wheel and the driven wheel are connected by the synchronous belt. The motor rotates the drive wheel to drive the driven wheel via the synchronous belt, and the driven wheel swings the swing arm, thereby driving the effect sheet to switch into and out from the light path in a swinging manner.

The effect module further includes an elastic reset element. The elastic reset element is arranged on the support plate. When the swing arm switches the effect sheet into the light path, the elastic reset element continuously applies a spring force to the swing arm to switch the effect sheet out from the light path. Therefore, when the effect sheet is switched into the light path and a stage light is abruptly powered down during operation, the effect sheet can utilize the spring force of the elastic reset element to cause the effect sheet to automatically exit the light path, thereby preventing the magnification module from dropping and breaking the effect sheet.

The support plate can be mounted with two of the swing arms. The two swing arms are configured to switch into the light path of the light source from two sides of the light path, respectively, under driving of the first driving mechanism. That is, the magnification module can pass between the two of the effect sheets when the effect sheets are both switched out from the light path. Therefore, the effect modules are prevented from interfering with sliding of the magnification module. The effect modules allow the magnification module to slide freely, so that sliding of the effect modules and sliding of the magnification module do not influence each other.

The effect sheet is one or more of a prism sheet, a pattern sheet, a frosting sheet, a color filter sheet. The prism sheet can split a light beam emitted by the light source module. The pattern sheet can cause the stage light to project a particular pattern. The frosting sheet can cause the light beam to become softer. The color filter sheet can change a color and a color temperature of the light beam. It should be noted that the plurality of effect sheets may be a combination of one or more of a single prism sheet, a single pattern sheet, a single frosting sheet and a single color filter sheet. Alternatively, each single one of the effect sheets may be a collective effect sheet formed of one or more of a prism sheet, a pattern sheet, a frosting sheet, and a color filter sheet. Optional combinations of the effect module are enriched by simultaneously arranging a plurality of types of the effect sheets on the effect module, and more stage lighting effects can be obtained by different combinations.

Compared with the existing technology, some beneficial effects can be obtained according to the present invention. The independent configuration of the effect module that can be slidable alone allows the effect module to avoid the magnification module, and the effect sheet can be switched in the light path at any position as desired between the focusing module and the light output lens, thereby eliminating limitation caused by the magnification module on switch-in of the effect sheet and constraints on light angle adjustment caused by the switch-in of the effect sheet, and thus enabling a stage light to switch in the effect sheet, such as prism or mirror frosting, at all angles and allowing the stage light to exhibit richer stage effects.

DETAILED DESCRIPTION OF THE EMBODIMENTS

Figure 1:
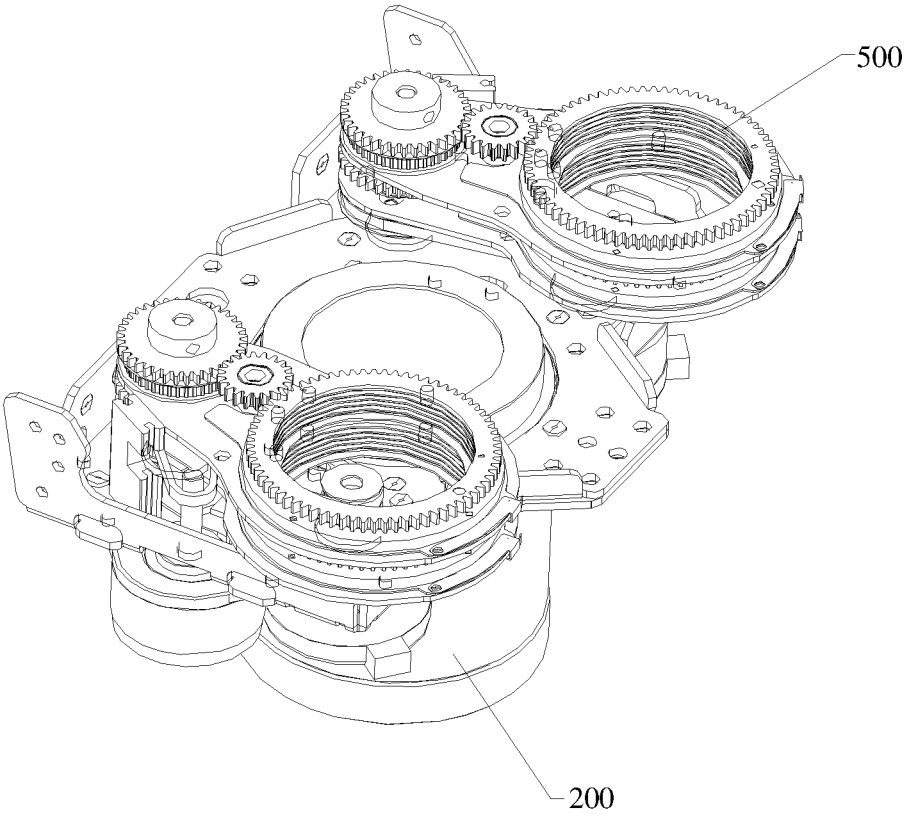
FIG. 1 is a schematic diagram of a structure, in which an effect module is mounted on a focusing module as described in the related art.

The drawings of the present invention are for illustrative purposes only and are not to be construed as limiting the invention. For better illustration of the following embodiments, certain components in the drawings may be omitted, enlarged or downsized, and sizes of these components do not represent sizes of actual products. It will be understood by those skilled in the art that certain well-known structures in the drawings and descriptions thereof may be omitted.

Figure 2:
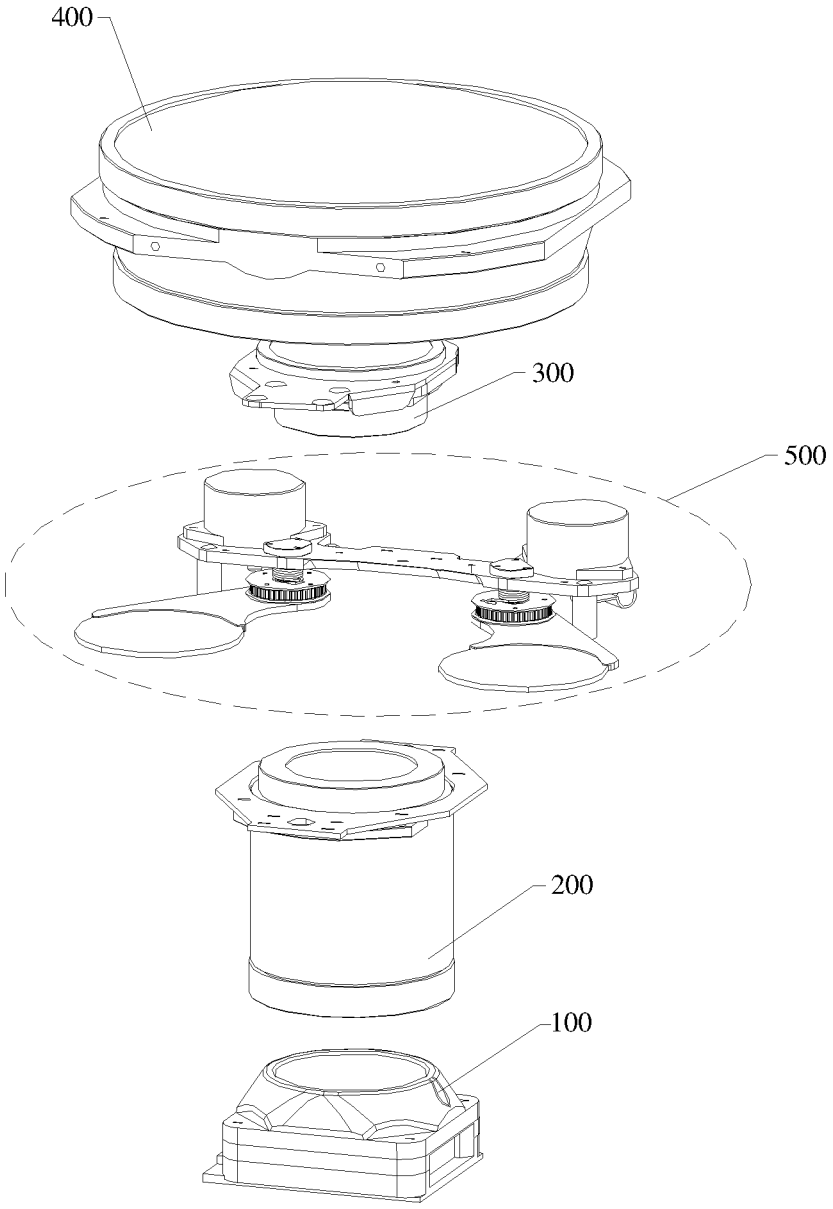
FIG. 2 is an exploded structural schematic diagram of a lighting effect adjustment system with sliding effect module according to the present invention.
Figure 3:
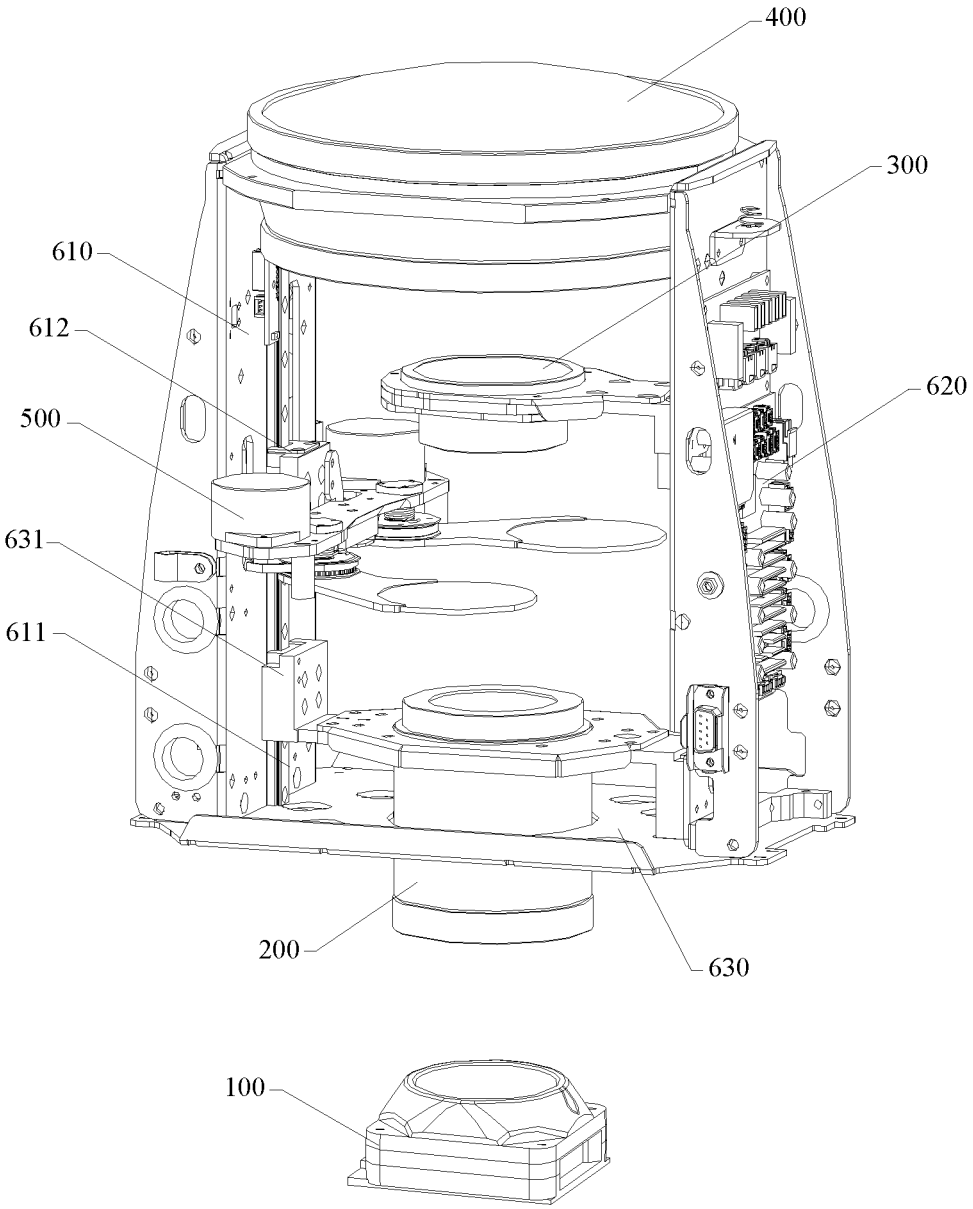
FIG. 3 is a schematic diagram of an overall structure of the lighting effect adjustment system with sliding effect module according to the present invention.
Figure 4:
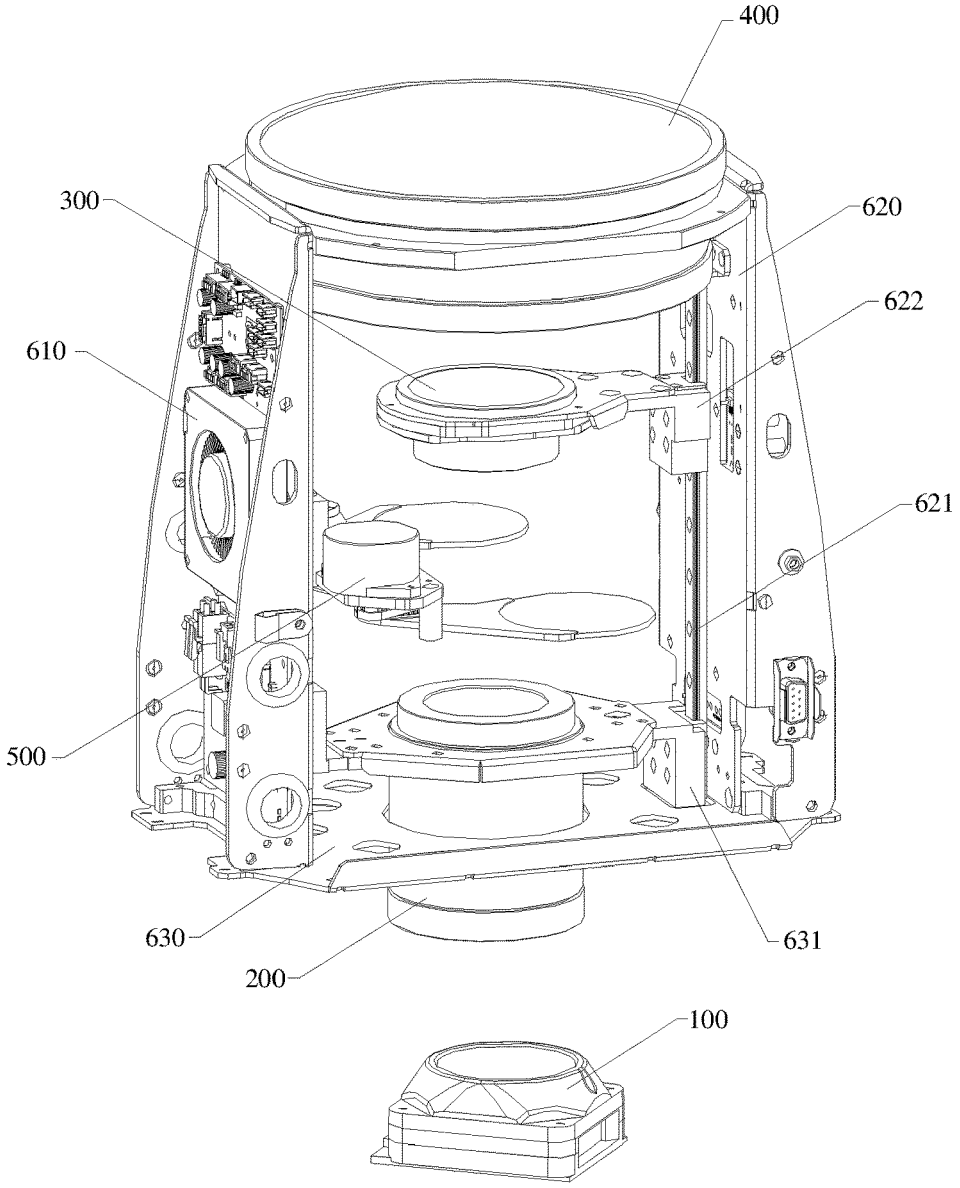
FIG. 4 is another schematic diagram of the overall structure of the lighting effect adjustment system with sliding effect module according to the present invention.

As shown in FIGS. 2 to 4, a lighting effect adjustment system with sliding effect module according to the present embodiment includes a stage light holder, a light source module 100, and a focusing module 200, a magnification module 300 and a light output lens 400 that are sequentially arranged along a beam projection direction of the light source module 100. The light source module 100, the focusing module 200 and the magnification module 300 are located on the same central axis. The stage light holder includes a first side plate 610 and a second side plate 620 that are arranged to face each other, and a bottom plate 630. An upper surface of the bottom plate 630 is substantially rectangular. A long side of the bottom plate 630 is provided with a folded vertical edge, and a center of the bottom plate 630 is provided with a light hole. The bottom plate 630 is provided with the light hole through which the focusing module 200 passes. Design of the light hole is to broaden a sliding space of the focusing module 200, which at least broadens a distance that is 50% of a length of the focusing module 200 by which the focusing module 200 can slide toward the light source module 100, so that the focusing module 200 can have a wider range for adjusting a light beam, and thus can meet more effect requirements. The first side plate 610 and the second side plate 620 are perpendicular to the bottom plate 630 and parallel to each other. The first side plate 610 and the second side plate 620 are respectively connected to two narrow sides of the bottom plate 630 and are fastened to the bottom plate 630 by screws. The first side plate 610 and the second side plate 620 are both rectangular plates. Narrow edges of the first side plate 610 and the second side plate 620 are connected to the bottom plate 630, while two long sides thereof are folded to form vertical edges that have a right-angled trapezoid shape. The vertical edges serve as a stiffener, and a bottom portion of the stiffener is also fixed to the bottom plate 630. A top portion of the stage light holder is provided with a circular first mounting location, two ends of the first mounting location are connected to the first side plate 610 and the second side plate 620, respectively. The light output lens 400 is fixed to the first mounting location.

A vertical center of an inner surface of the first side plate 610 is provided with a first slide rail 611. One end of the first slide rail 611 is in contact with the bottom plate 630, while the other end thereof is in contact with an edge of the first mounting location. The first slide rail 611 is provided with two sliding members, including a first sliding member 612 located above and a third sliding member 631 located below. The first sliding member 612 is connected to the effect module 500, and the third sliding member 631 is connected to the focusing module 200. A vertical center of an inner surface of the second side plate 620 is provided with a second slide rail 621 on which sliding members are also provided, including a second sliding member 622 located above and a third sliding member 631 located below. The second sliding member 622 is connected to the magnification module 300, and the third sliding member 631 is connected to the focusing module 200. The first sliding member 612, the second sliding member 622 and the third sliding member 631 are all connected to a second driving mechanism that includes drive belts and drive motors. The first sliding member 612, the second sliding member 622 and the third sliding member 631 are connected to the respective drive belts, and the corresponding drive motors drives the first sliding member 612, the second sliding member 622 and the third sliding member 631 to slide up and down along the corresponding first and second slide rails 611 and 621 via the drive belts. Alternatively, the focusing module 200 may only have one end slidably arranged on the first side plate 610 or the second side plate 620, that is, the focusing module 200 may have only one end provided with the third sliding member 631 that is slidable along the first slide rail 611 or the second slide rail 621. Each drive belt is typically a flexible belt, and a stepper motor is employed as each drive motor. An advantage of using the drive belt to perform a drive process is that the drive belt is smooth during the drive process, while a belt drive has a certain protective effect, which can prevent, by slipping, damage to equipment caused by violent pulling on driven members when the drive motor fails.

Figure 5:
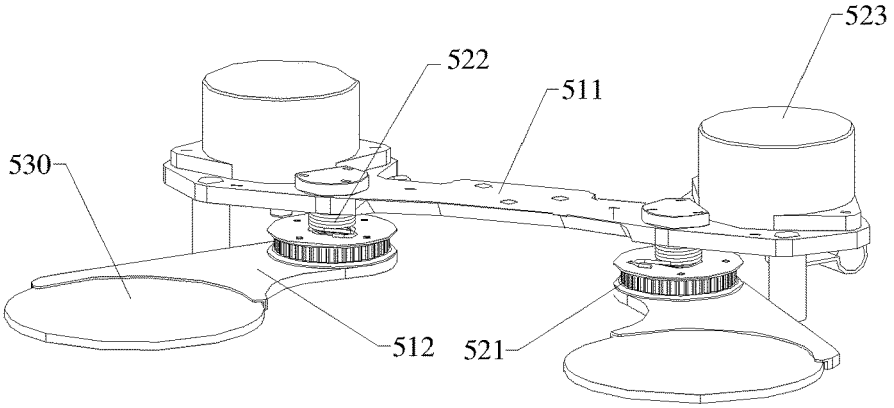
FIG. 5 is a partially enlarged view of an effect module 500 shown in FIG. 2.
Figure 6:
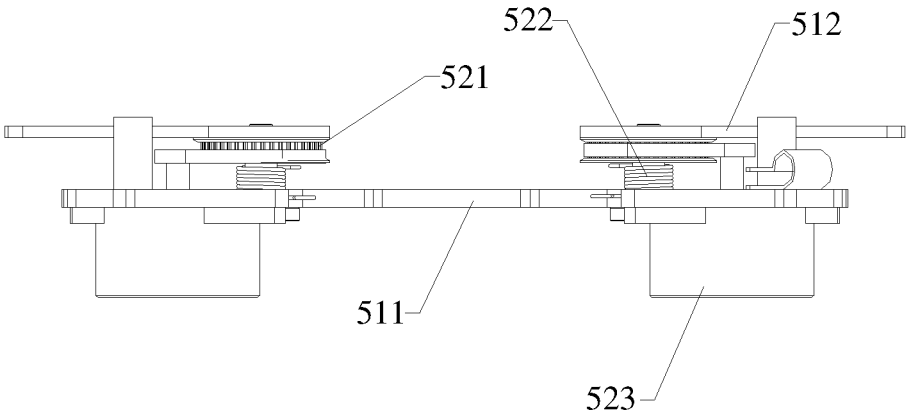
FIG. 6 is a front view of the effect module according to the present invention.
Figure 7:
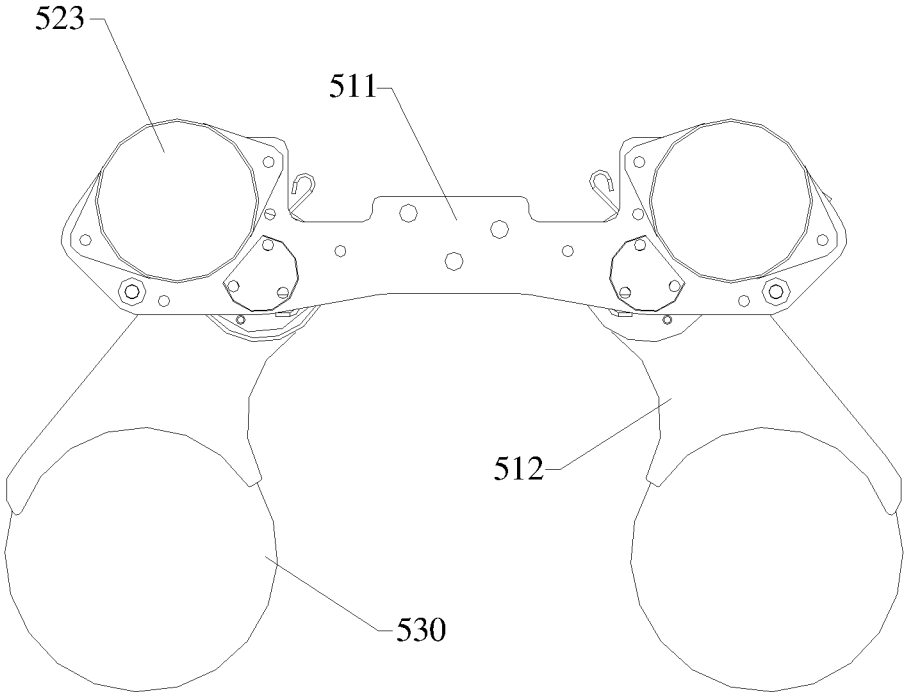
FIG. 7 is a top view of the effect module according to the present invention.

As shown in FIGS. 5 to 7, the effect module 500 includes two effect sheets 530, two swing arms 512, and an elongated support plate 511. The two effect sheets 530 are a frosting sheet and a prism, respectively. Alternatively, the two effect sheets 530 may also be a pattern sheet, a color filter sheet, or the like. Each of the two effect sheets 530 is mounted at one end away from the support plate 511 of each swing arm 512. Two first driving mechanisms that are mounted at two ends of the support plate 511, which respectively drives the two effect sheets 530 to switch into and switch out from a light path in a swinging manner. Alternatively, the effect sheets may share the same first driving mechanism, for example, the effect sheets are stacked and the first driving mechanism drives the effect sheets to switch into and switch out from the light path at the same time, thereby achieving a superimposed arrangement of a plurality of effects and thus enriching lighting effects. Each first driving mechanism includes a motor 523, a synchronous belt, a drive wheel and a driven wheel 521. The drive wheel is fixed to an output shaft of the motor 523. The driven wheel 521 is fixed to one end away from the effect sheet 530 of the swing arm 512. The drive wheel and the driven wheel 521 are connected by the synchronous belt. The effect module 500 further includes an elastic reset element 522. The elastic reset element 522 is arranged on the support plate 511. The elastic reset element 522 continuously applies a spring force to the swing arm 512 switch the effect sheet 530 out from the light path when the effect sheet 530 is switched into the light path by the swing arm 512. In the present embodiment, the elastic reset element 522 is a spring coil. The support plate 511 is provided with a fixed shaft. The driven wheel 521 is sleeved onto the fixed shaft. The fixed shaft is wound with the spring coil 522. One end of the spring coil 522 is resisted against the support plate 511 and fixed to the support plate 511. The other end of the spring coil 522 is resisted against the driven wheel 521 and fixed to the driven wheel. The driven wheel 521 is sleeved on the fixed shaft via a bearing, and a top end of the fixed shaft is provided with a locking member that prevents the bearing from falling off. Heights of the two effect sheets 530 relative to the support plate 511 can also be controlled by adjusting a height of the fixed shaft. It is preferable that the heights of the effect sheets 530 relative to the support plate 511 are equal. The support plate 511 is mounted with the two swing arms 512, so that the two swing arms 512 can switch into the light path of the light source from two sides of the light path, respectively, under driving of the respective first driving mechanism. When the effect sheets 530 are all switched out from the light path, the magnification module 300 can pass between the two effect sheets 530. A bypass space where the magnification module 300 freely passes is thus formed by the two swing arms 512 and the support plate 511. Preferably, an edge of the bypass space is 2 to 3 mm away from an edge of the magnification module 300.

Figure 8:
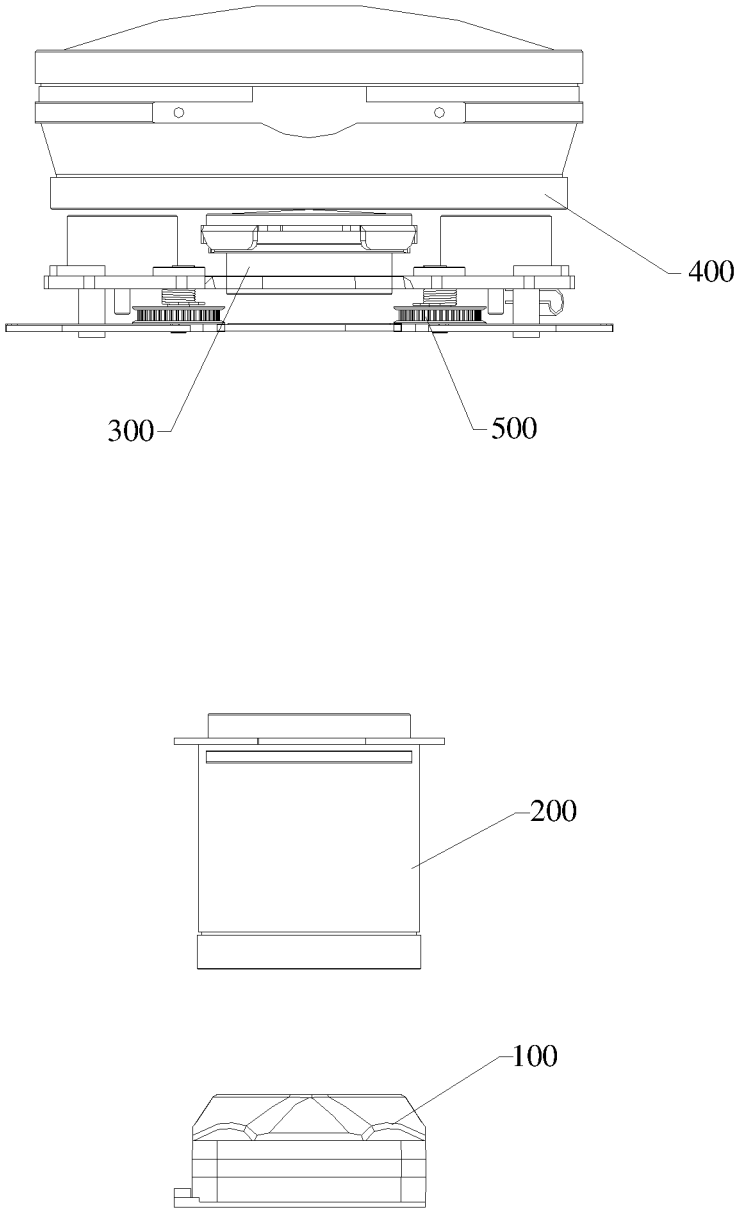
FIG. 8 is a schematic diagram showing that an effect sheet is switched into a light path when the effect module is located at a first position according to the present invention.
Figure 9:
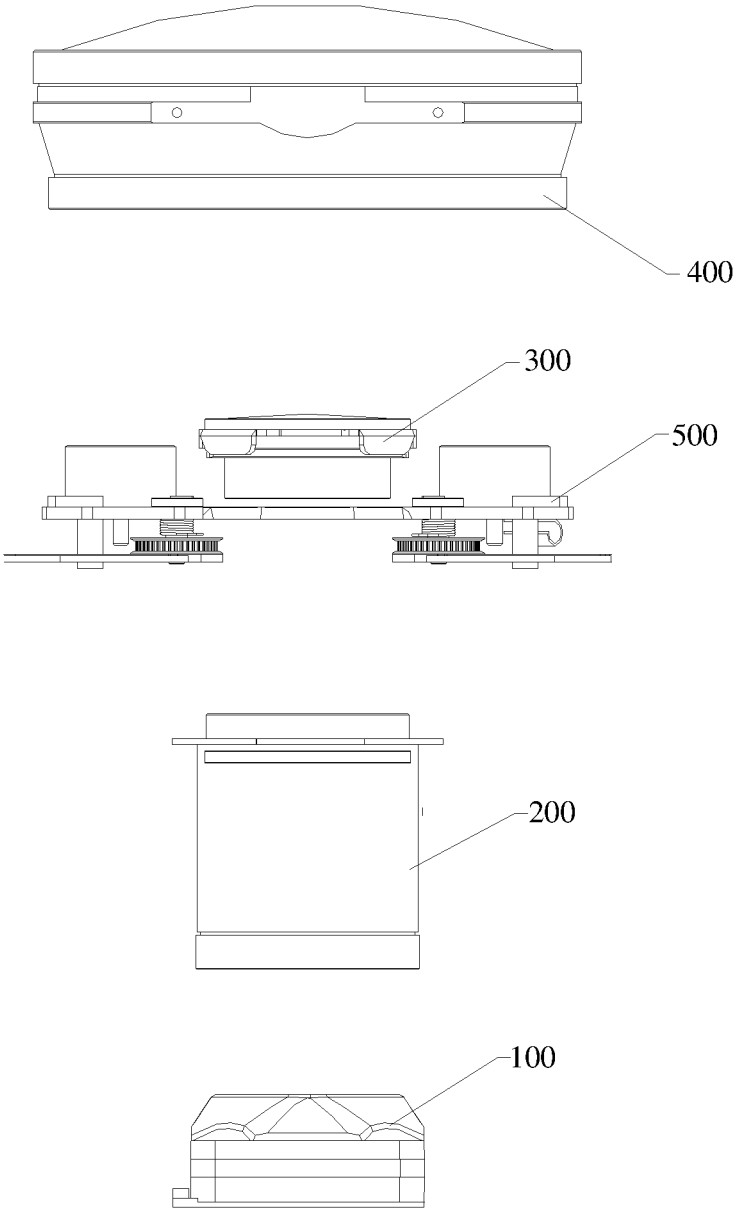
FIG. 9 is another schematic diagram showing that the effect sheet is switched into the light path when the effect module is located at the first position according to the present invention.

FIGS. 8 and 9 shows how to adjust a beam effect of a stage light by the lighting effect adjustment system with sliding effect module. When there is a sufficient space between the focusing module 200 and the magnification module 300 for the effect sheets 530 to switch into the light path, the effect module 500 slides between the focusing module 200 and the magnification module 300. In this case, the effect sheets 530 are switched into the light path when the effect module 500 is located in the first position and close to the magnification module 300. The prism sheet or the frosting sheet can be switched in alone, or the prism sheet and the frosting sheet can be switch into the light beam together to obtain a desired effect. As shown in FIG. 8, it should be noted that the effect sheets 530 is preferably switched into the light path with the effect module 500 in the first position, when there is sufficient space for witching-in of the effect sheet 530 at both sides adjacent to and away from the focusing module 200 of the magnification module 300. Such configuration makes the elements of the system at a lower position, which ensures smoother operation of the system.

According to some embodiments, the focusing module 200 may provide with another effect module 500 with the conventional design. When there is a sufficient space between the focusing module 200 and the magnification module 300, the effect sheets 530 provided on the focusing module 200 and the effect sheets 530 of the individually provided effect module 500 may be simultaneously switched in the light path, which can achieve richer stage effects.

Figure 10:
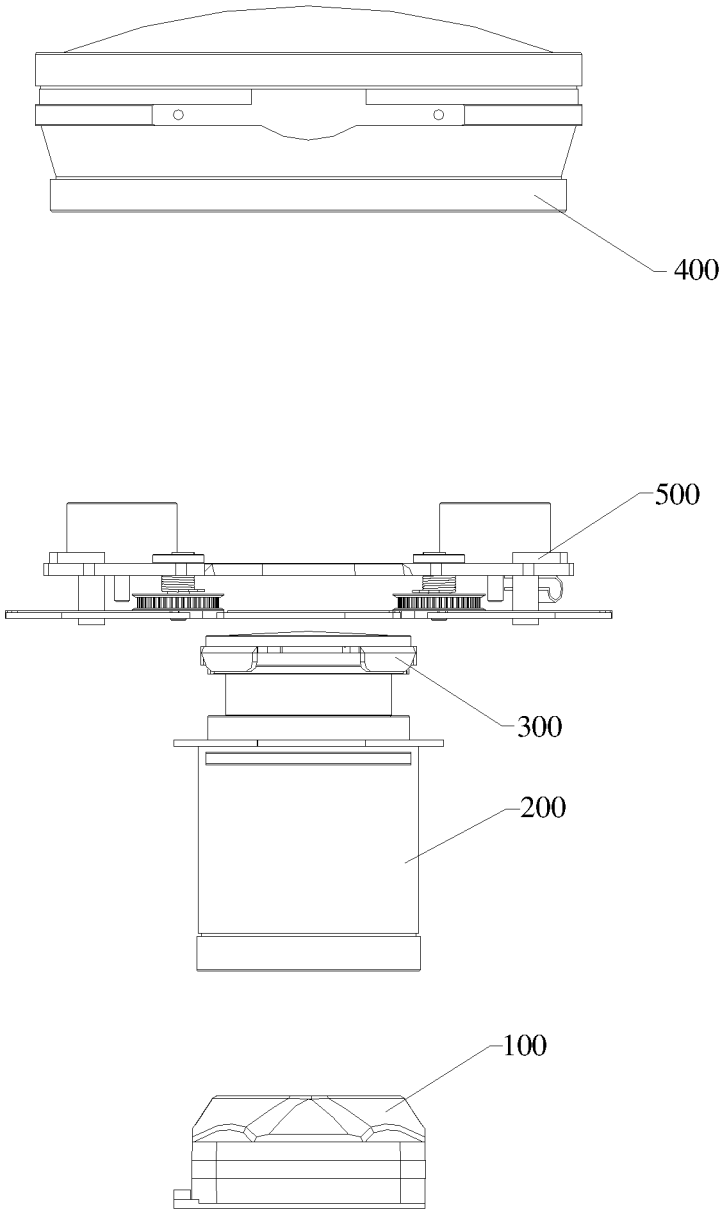
FIG. 10 is a schematic diagram showing that the effect sheet is switched into the light path when the effect module is located at a second position according to the present invention.

FIG. 10 shows another embodiment about how to adjust a beam effect of a stage light by the lighting effect adjustment system with sliding effect module. In a certain case, the magnification module 300 needs to be moved to a position that is very close to the focusing module 200 due to a required angle, resulting in that the effect sheet 530 cannot be switched between the magnification module 300 and the focusing module 200. At this time, the effect module 500 is moved to the side away from the focusing module 200 of the magnification module 300. The effect module 500 is thus in a second position and the effect sheet 530 is switched into the light path at a position adjacent to the magnification module 300 above a magnification lens thereof. The frosting effect sheet 530 or the color filter effect sheet 530 is generally switched into the light path at this position. During actual use, the effect module 500 is always moved between the focusing module 200 and the light output lens 400, and is selectively switched into the light beam depending on actual situations to free from the influence of adjustment of light angles.

Obviously, the above embodiments of the invention are merely examples for clear illustration of the invention, and are not intended to limit the implementation of the invention. Any modifications, equivalents, improvements, and the like that come within the spirit and principles of the claims of the invention are intended to be encompassed within the scope of the claims of the invention.

The invention claimed is:

1. A lighting effect adjustment system with sliding effect module, comprising a light source module;

a focusing module;

a magnification module; and a light output lens, wherein the focusing module, the magnification module and the light output lens are arranged in sequence along a beam projection direction of the light source module, and mounted on a stage light holder, the focusing module and the magnification module are independently slidable in a light path direction, wherein an effect module is slidably arranged between the focusing module and the light output lens, which comprises at least one effect sheet configured to be switched into and out from a light path, and the effect module and the magnification module are moveable independently without interference with each other, and wherein a first position is included where the effect module is located on one side of the magnification module adjacent to the focusing module, and a second position is included where the effect module is located on one side of the magnification module opposite to the focusing module.

2. The lighting effect adjustment system with sliding effect module according to claim 1, wherein the stage light holder comprises a first side plate and a second side plate opposite to each other, the effect module is slidable between the focusing module and the light output lens by a first lifting component arranged on the first side plate, and the magnification module is slidable between the focusing module and the light output lens by a second lifting component arranged on the second side plate.

3. The lighting effect adjustment system with sliding effect module according to claim 2, wherein the first lifting component comprises a first slide rail and a first sliding member, the first slide rail is arranged on the first side plate and is parallel to the light path direction, and the first sliding member is provided on one end of the effect module adjacent to the first side plate and is slidable on the first slide rail; and wherein the second lifting component comprises a second slide rail and a second sliding member, the second slide rail is arranged on the second side plate and is parallel to the light path direction, and the second sliding member is provided at one end of the magnification module adjacent to the second side plate and is slidable on the second slide rail.

4. The lighting effect adjustment system with sliding effect module according to claim 2, wherein one end of the focusing module adjacent to the first side plate is slidably arranged on the first side plate, and other end of the focusing module adjacent to the second side plate is slidably arranged on the second side plate.

5. The lighting effect adjustment system with sliding effect module according to claim 1, wherein the effect module further comprises a clamping bracket and a first driving mechanism, the clamping bracket has a swing arm and a support plate, one end of the swing arm holds the effect sheet and the other end thereof is movably arranged on the support plate, and the first driving mechanism is arranged on the support plate and configured to drive the swing arm to switch into and switch out from a light path.

6. The lighting effect adjustment system with sliding effect module according to claim 5, wherein the first driving mechanism comprises a motor;

a synchronous belt;

a drive wheel, which is fixed to an output shaft of the motor; and a driven wheel, which is fixed to one end of the swing arm away from the effect sheet, wherein the drive wheel and the driven wheel are connected by the synchronous belt.

7. The lighting effect adjustment system with sliding effect module according to claim 5, wherein the effect module further comprises an elastic reset element which is arranged on the support plate, wherein when the effect sheet is switched into the light path by the swing arm, the elastic reset element continuously applies a spring force to the swing arm to switch the effect sheet out from the light path.

8. The lighting effect adjustment system with sliding effect module according to claim 5, wherein the support plate is mounted with two of the swing arms, and the swing arms are configured to switch into the light path of the light source module from two sides of the light path, respectively, under driving of the first driving mechanism.

9. The lighting effect adjustment system with sliding effect module with according to claim 8, wherein when each swing arm is switched out from the light path, a bypass space where the magnification module is able to freely pass is formed by the two swing arms and the support plate.

10. The lighting effect adjustment system with sliding effect module according to claim 1, wherein the effect sheet is one or more of a prism sheet, a pattern sheet, a frosting sheet, and a color filter sheet.

* * * * *